United States Patent [19]

Kundrot

[11] Patent Number: 4,522,843

[45] Date of Patent: Jun. 11, 1985

[54] DEACIDIFICATION OF LIBRARY MATERIALS

[76] Inventor: Robert A. Kundrot, 3801 D Logans Ferry Rd., Pittsburgh, Pa. 15239

[21] Appl. No.: 573,739

[22] Filed: Jan. 25, 1984

[51] Int. Cl.[3] ..... B05D 1/04; B05D 1/06

[52] U.S. Cl. ..... 427/27; 427/180; 427/421; 427/427; 428/537.1; 162/160; 162/181.4

[58] Field of Search ..... 427/439, 248.1, 255.3, 427/395, 180, 27, 44, 427, 202; 162/160, 181.2, 181.4; 252/385, 397, 189; 428/537, 702; 8/119

[56] References Cited

U.S. PATENT DOCUMENTS

| | | | |
|---|---|---|---|
| 2,033,452 | 3/1936 | Schierholtz | 427/395 |
| 2,864,723 | 12/1958 | Fluck et al. | 427/389.9 |
| 3,472,611 | 10/1969 | Langwell | 427/395 |
| 3,676,055 | 7/1972 | Smith | 427/395 |
| 3,676,182 | 7/1972 | Smith | 427/439 |
| 3,898,356 | 8/1975 | Williams et al. | 427/343 |
| 3,969,549 | 7/1976 | Williams et al. | 162/160 |
| 4,051,276 | 9/1977 | Williams et al. | 162/160 |

*Primary Examiner*—Shrive P. Beck

[57] ABSTRACT

A method is provided of deacidifying books, imaged paper and other imaged material having a cellulose base comprising treating said material with suitable alkaline particles of basic metal oxide, hydroxide or salt dispersed in a gas or liquid in an amount and for a time sufficient to increase the pH of the material and provide an alkaline buffer without impairing the image thereon, said liquid consisting essentially of an inert halogenated hydrocarbon and a surfactant.

24 Claims, No Drawings

DEACIDIFICATION OF LIBRARY MATERIALS

BACKGROUND OF THE INVENTION

The deterioration of paper, books and newspapers is a well-known and growing concern to librarians and archivists throughout the world. The causes of paper deterioration are numerous and include inherent acidity, photodegradation, oxidation, and even microbiological attack under certain conditions. These factors combined with initial paper quality have severely reduced the permanence of library and archival collections. A host of other phenomenon such as flood, fire, vandalism, etc. certainly add to these problems; however, it is becoming generally accepted that the most insidious problem is the acidity of most book paper produced in the last one hundred years.

The demand for large amounts of printing paper over the last century led to the introduction of pulp fiber produced from wood by chemical or mechanical means. However, paper made from untreated wood pulp is too absorbent to allow sharp image imprint. Therefore, chemicals have to be added to the wood fibers during processing. These additives allow the paper to accept inks and dyes and increase paper opacity. Unfortunately, most of these chemicals are either acidic or are deposited by acidic mechanisms which initiate the slow, but relentless acidic deterioration of paper. Other contributions to the acidification of paper are supplied by man through industrial emissions of sulphur and nitrogen and carbon oxides or by natural processes such as sea salt spray. Even books or paper of neutral and alkaline character are not immune. As neighboring papers of acidic nature degrade, volatile acids are produced which either diffuse through adjoining books or permeate the atmosphere and may ultimately acidify even the "safe or stable" books.

In order to arrest this acidic degradation, paper materials must be deacidified and provided with an alkaline reserve or buffer to retard a return to an acidic state. Currently, there are several processes either in various stages of development or commercialization for deacidifying paper whether bound or unbound. Numbering amoung these are processes using volatile metal alkyls e.g. U.S. Pat. Nos. 3,969,549, and 4,051,276, and volatile amines e.g. U.S. Pat. Nos. 3,472,611, 3,771,958 and 3,703,353. U.S. Pat. No. 3,676,182 issued July 11, 1972 describes the treatment of cellulosic materials with alkali and alkaline earth bicarbonates, carbonates, and hydroxides (Col. 17) in a halogenated hydrocarbon solvent or lower aliphatic hydrocarbon such as n-butane (Col. 7) with an optional plasticizing agent such as ethylene glycol (Col. 9). U.S. Pat. No. 3,676,055 issued July 11, 1972 to Smith describes a nonaqueous deacidification solution for treating cellulosic materials comprising 1000 cc of 7 percent magnesium oxide, (sic magnesium methoxide) in methanol and in addition 20 pounds of dichlorodifluoromethane (Freon 22). Canadian Pat. No. 911,110 issued Oct. 3, 1982 to Smith describes a deacidification solution (p 5) of a 7% magnesium methoxide solution in methanol (10 parts) and a halogenated solvent or solvents (90 parts); and states that a magnesium alkoxide reacts with water in paper to form a mildly alkaline milk of magnesia, being magnesium hydroxide (p 31). Improved results are reported with the use of the halogenated hydrocarbon solvents (p 40).

Unfortunately, all of these processes suffer from one or more of a number of drawbacks that have prevented their wide-spread acceptance. These drawbacks include high cost, toxicity, complexity of treatment, residual odor, deleterious effects on certain types of paper and inks, lack of an alkaline reserve, and the necessity of drying the book or paper to very low moisture contents before treatment.

BRIEF DESCRIPTION OF THE INVENTION

It has now been discovered that acidic cellulosic materials can be treated with non-toxic inexpensive materials in a manner which obviates or minimizes many of the problems of the prior art including the necessity for drying the book or paper prior to treatment. This method can be used on cellulosics (paper) even when such paper is imprinted and or bound. More particularly, it has been discovered that books, paper and other material having a cellulose base can be preserved by treatment with alkaline material particles of basic metal oxides, hydroxides or salts (hereinafter alternatively referred to as alkaline or basic material) in an amount and for a time sufficient to increase the acidic pH of the material and provide an alkaline buffer. Quite surprisingly, it is not necessary to neutralize the acids present within the confines of the treatment period. Rather, a basic metal oxide, hydroxide, or salt of suitable particle size is distributed through the cellulosic or paper web wherein these particles slowly stop and neutralize the acidic compounds present or produced during ageing. These basic materials are also present in sufficient amounts to buffer against reacidification by other acidic influences to which the paper may later be subjected to in storage.

The alkaline materials are regularly available materials and are preferably chosen from those which are relatively non-toxic. These particles are of such a size that they do not substantially interfere with any image, are colorless, and provide good coverage. Submicron or near submicron particles are suitable as these can be suspended in a gas or inert liquid which obviates the need for solutions or solvents which contribute to many of the drawbacks of current methods. Particles of these dimensions are also tightly held within the paper matrix and do not loosen under normal use. Typical BET surface areas range from 50 to 200 $m^2/g$ which provides high probabilty of acid contact and interdiction.

The invention will be further described in the following detailed description of the invention.

DETAILED DESCRIPTION OF THE INVENTION

The cellulosic materials can be treated with any suitable basic metal oxide, hydroxide or salt. Suitable materials are the oxides, hydroxides, carbonates and bicarbonates of the Group 1 and 2 metals of the Periodic table and zinc. Preferred are the materials in which the cation is magnesium, zinc, sodium, potassium, or calcium. Particularly preferred are the relatively non-toxic oxides, carbonates and bicarbonates of magnesium and zinc and the hydroxides of sodium, potassium and calcium. Represenative examples include magnesium oxide, magnesium carbonate, magnesium bicarbonate, zinc carbonate, zinc bicarbonate, zinc oxide, sodium hydroxide, potassium hydroxide and calcium hydroxide. Magnesium oxide is most preferred. The predominant particle size (95–99%) is preferably between 0.01 and 0.9 micron, the average particle size is preferably between 0.2 and 0.6 micron and most preferably is about 0.4 micron. Typical surface areas are between 50 and 200 $m^2/g$ BET preferably about 170 $m^2/g$.

The particles can be formed by burning the elemental metal and collecting the smoke, attrition of the preformed oxides or calcination of the elemental salts. For example, basic magnesium carbonate can be calcined at 450° C.–550° C. to produce a polydisperse high activity magnesium oxide with an average particle size of 0.4 microns and a predominant particle size between 0.1 and 0.9 micron.

The particles can be applied in the paper making process or to the finished paper by electrostatic transfer such as in a xerographic process, by a dispersion in a gas, or by a suspension in an inert liquid. In the case of a liquid suspension of the particles, the liquid chosen is preferably inert and possessing a high enough vapor pressure to allow its removal from the book or paper after exposure. Liquids which are well suited for this purpose are halogenated hydrocarbons. Typical materials include Dupont Freon Fluorcarbons such as Freon 11 (trichloromonofluoromethane), Freon 113 (1,1,2-trichloro-1,2,2-trifluoroethane), and Freon 114 (1,2-dichloro-1,1,2,2-tetrafluoroethane, and Allied Chemical Genetron 11 and 113 and mixtures. The suspension is less prone to settling and/or agglomeration if a surfactant is employed to overcome surface tension and charge attraction effects. Typical materials include surfactants such as ICI Solsperse 6000 and 3000 and 3M Fluorad FC 740 and 721. Mixtures of these surfactants can be employed. A preferred surfactant is a fluorinated alkyl ester known as Fluorad FC 740.

The amount of surfactant and alkaline material will depend in part on the length of treatment and the amount of deposition desired. Generally, however, the concentration of alkaline material will be between about 0.01% and about 0.3% and the surfactant between about 0.005% and about 1.0%. A most preferred range for the basic material particles is between about 0.01% and about 0.2%, and a most preferred range for the surfactant is between about 0.005% and about 0.5%.

In the case of unbound or single sheets of paper, deposition may take place using a gas or air supported dispersion. Active methods of deposition enhancement such as aerosol impingement, filtering through the paper and electrostatic attraction have proved promising for increasing the rate of deposition. Impingement of the gas supported dispersion on the paper combined with electrostatic attraction is particularly effective. In this method, paper is placed against a charged plate and the field so created is used to attract the particles to the paper.

The preferred method for bound sheet materials such as books or manuscripts is the use of a suspension in a liquid. The liquid is used not only to disperse the particles, but also to open the bound material to provide uniform treatment. By the use of spray nozzles or motion imparted to the bound material while submerged, pages can be easily separated and exposed to the particles. In a liquid suspension, one is able to obtain a higher concentration of particles in the treating media and deposit the necessary amount of alkaline material in a shorter time. By the use of halogenated hydrocarbon/-surfactant combinations, the stable concentration of submicron particles can be increased from 20–30 milligrams/cubic foot in a gas to 1–100 grams/cubic foot in a liquid. At the higher concentrations, one immersion into the treating medium for a few seconds will usually suffice to deposit the required amount of basic material. At the lower concentrations, two or more immersions or a longer immersion time is required to achieve the same effect. After immersion, the inert liquid is evaporated, recovered and recycled.

The following examples will serve to illustrate the invention. All parts and percentages in the specification and claims are by weight, unless otherwise indicated.

EXAMPLE 1

Sample imaged acidic sheets were treated with an air supported dispersion of MgO powder (average 0.4 micron particle size with a predominant particle size between 0.01 and 0.9 micron and a concentration of 25 mg/cubic foot). The sheets were hung in a glove box adapted to control the humidity at 32% and the initial temperature was 22° C. at standard atmosphere. The particles were transported to the glove box through lines connected to the exhaust of a Trost Air Mill. After a three hour exposure to the static air dispersion, the pH of the paper increased to 6.6 from an intial pH of 4.4 and the image was not impared.

EXAMPLE 2

Three sample imaged acidic sheets with a pH of 4.3 were dried in an oven at 50° C. for one hour and then placed in a glove box at conditions described in Example 1. Then a magnesium oxide dispersion in air as described in Example 1 was pumped into the box, and a container of warm water (40° C.) was uncovered. The relative humidity went from 34 to 94% in ten minutes and the water container was closed after ten minutes and the dispersion treatment was discontinued in 1½ hours. The humidification treatment of the paper increased the deposition rate by more than two fold over that in Example 1. The sample sheets facing the dispersion had a pH from 7.2 to 8.7.

EXAMPLE 3

A sheet of imaged acidic book paper (pH 4.0) was placed in contact with the charged sphere of an electrostatic generator (WINSCO Model N 100-v). A stream of dispersed particles described in Example 1 was directed against the paper for approximately 5 seconds. The pH of the paper after exposure was 8.5, and the image was not imparied.

EXAMPLE 4

A liquid treating suspension was prepared by adding 3.2 G. (0.20%) of MgO (prepared by calcining basic hydromagnesite at 500° C. for 3 Hours) to 1000 ml. of Allied Chemical Genetron - 113 containing 0.78 g (0.05%) of 3M Fluorad FC 740 surfactant. This suspension was used to treat single sheets of imaged acidic book paper by submerging each sheet into the suspension for 20 seconds. The sheets were then air-dried. These sheets (40) along with an equal number of untreated sheets were subjected to accelerated ageing according to TAPPI standard T 453 m-48 for up to 28 days. After samples were removed from the oven, the folding endurance test values of the paper were determined by using an MIT folding endurance tester (TAPPI standard T 511 su-69). The pH values were determined with a flat probe electrode according to TAPPI standard T 529 pm-74. The results were as follows:

ACCELERATED AGEING TESTS AT 105° C. EFFECT ON M.I.T. FOLD ENDURANCE AND pH

| Time in Days at 105° C. | Untreated Fold | Untreated pH | Treated Fold | Treated pH |
|---|---|---|---|---|
| 0 | 108 | 6.4 | 105 | 9.4 |
| 14 | 43 | 6.0 | 97 | 8.1 |
| 28 | 7 | 5.4 | 35 | 8.2 |

Note: Fold endurance is the number of double folds under a 0.5 Kg. tension before failure. Paper is considered brittle and unusable at 5 or less folds.

This paper was from a book 37 years old. The only method presently available to determine the effects of treatment is to subject the paper to some form of accelerated ageing, in this case dry heat, and directly compare the strength retention of treated and untreated samples as shown above. The increase in life expectancy can be estimated by converting the folding endurance test values to logrithmic values and computing the regression equations of the treated and untreated paper with respect to time of accelerated ageing. Then the slopes of the resultant equations are directly compared. When this method was applied to the data above, the life expectancy of the treated paper was increased two and one-half times over its untreated counterpart.

EXAMPLE 5

The liquid suspension prepared as in Example 4 was used on a newer book (age six years) with a much higher initial fold endurance. Paper taken from this book had an average pH of 5.0. After treatment as described in Example 4, the treated paper had an average pH of about 9.0. The results of accelerated ageing are shown below:

ACCELERATED AGEING TESTS - EFFECT ON M.I.T. FOLD ENDURANCE

| EXPOSURE TIME DAYS | 105° C. UNT'D | 105° C. TRT'D | 70° C. SAT'D R.H. UNT'D | 70° C. SAT'D R.H. TRT'D |
|---|---|---|---|---|
| 0 | 1656 | 1656 | 1406 | 1390 |
| 7 | 281 | 498 | 933 | 1160 |
| 14 | 19 | 149 | 619 | 969 |
| 21 | 2 | 45 | 410 | 809 |
| 28 | 0 | 2 | 272 | 676 |

The accelerated ageing at 70° C. in a water saturated atmosphere was done to show the effects of moisture during exposure. Although the paper lost strength slower at the moist conditions probably due to the lower temperature, acidic hydrolysis was probably enhanced. This was indicated by the pH decreases before and after exposure. The pH of the untreated paper dropped from 5.0 to 4.5 after 28 days in the dry oven, but fell to 3.7 under moist conditions. The treated samples remained about pH 9.0 in the dry oven, but fell to pH 6.6 in the moist oven after 28 days. These results indicate an increase of almost twofold in expected shelf life by dry oven ageing and somewhat more than that by moist oven ageing. Samples were removed after treatment and again after 14 days of dry oven exposure and measured for brightness. This was done when it was noticed that the treated samples appeared much whiter than the untreated samples after dry oven exposure. The brightness measurements were taken according to TAPPI standard T 452. The untreated paper fell in brightness from an average of 73.7 to 65.6, about 12%, that of the treated samples fell from 74.4 to 69.5, about 7%.

EXAMPLE 6

A 30-gallon capacity tank was filled with 20 gallons of treating suspension as described in Example 4. A bound manuscript (average pH 3.9) characterized as having a strong binding was placed with its spine against the angle of a V-shaped metal tray (angle 90 degrees). The assembly was weighted and lowered vertically (book spine perpendicular to the tank bottom) into the suspension. The bottom edge of the book block was approximately an inch above the tank bottom. A low impact, wide deflection, flat pattern spray nozzle was directed to spray downwards against the top edge of the book. The flow rate was one and one-half gallons per minute. The effect of the spray fanned the pages of the book very evenly. After five minutes, the book was removed and placed into a vacuum oven. The chamber was evacuated for 45 minutes during which time almost 100% of the fluorocarbon liquid was recovered in a refrigerated trap. Several random pH measurements on the book indicated values from 8.5–8.7. An indicator, bromocresol purple, was brushed on several pages and showed that the method used results in excellent uniformity with no image impairment.

EXAMPLE 7

The tank used in Example 6 was filled with 20 gallons of a suspension consisting of 0.3 grams (0.02%) of submicron magnesium oxide with 0.15 grams (0.01%) of Fluorad FC 740 surfactant per liter. A bound volume (average pH 4.1) characterized as having a weak binding was secured to the same V-shaped tray as described in Example 5. The assembly was lowered into the suspension with the foreedge of the book pointed up. After allowing the book to seperate for three minutes, the book was gently moved up and down in the suspension for an additional two minutes. Before removing the book, one cover was freed and the assembly was rotated 45 degrees in a direction opposite from the free edge. As the volume was withdrawn from the suspension, the book closed freely with little or no stress applied on the binding. The pH after after air drying varied from 6.1 to 7.3 with no image impairment.

While the invention has been illustrated with the use of MgO, other alkaline materials can be used in similar or like amounts. Similarly, other surfactants and inert volatile liquids for the disperions may be obvious to one skilled in the art.

What is claimed is:

1. A method of deacidifiying books, imaged paper and other imaged material having a cellulose base comprising treating said material with suitable alkaline particles of a basic metal selected from the group consisting of oxides, hydroxides and salts having a predominant particle size between 0.01 and 0.9 micron and a surface area between 50 and 200 $m^2/g$ BET, dispersed in a gas with deposition enhancement by aerosol impingement, filtering through the paper or electrostatic attraction or dispersed in a liquid, in an amount and for a time sufficient to pass into the interstices of said imaged material and increase the PH of the material and provide an alkaline buffer without impairing the image thereon, said liquid consisting essentially of an inert halogenated hydrocarbon and a surfactant.

2. The method of claim 1 wherein the alkaline particles have an average particle size between 0.2 and 0.6 micron.

3. The method of claim 1 wherein the basic metal is magnesium oxide.

4. The method of claim 1 wherein the basic metal is a salt selected from the group consisting of magnesium carbonate, zinc carbonate, sodium carbonate, potassium carbonate, calcium carbonate, sodium hydroxide, potassium hydroxide and calcium hydroxide.

5. The method of claim 1 wherein the basic metal is a salt of calcium carbonate.

6. The method of claim 1 wherein the basic metal is a salt of zinc carbonate.

7. The method of claim 1 wherein the particles are electrostatically transferred to the material.

8. The method of claim 1 wherein an aerosol is formed of the particles in a gas.

9. The method of claim 8 wherein the gas is selected from air, carbon dioxide, nitrogen and argon.

10. The method of claim 1 wherein an aerosol is formed of the particles in air.

11. The method of claim 1 wherein the alkaline particles are applied at high humidity.

12. A method of deacidifying books, imaged paper and other imaged material having a cellulose base comprising treating said material with suitable alkaline particles of a basic metal selected from the group consisting of oxides, hydroxides and salts dispersed in a liquid in an amount and for a time sufficient to increase the pH of the material and provide an alkaline buffer without impairing the image thereon, said liquid consisting essentially of an inert halogenated hydrocarbon and a surfactant.

13. The method of claim 12 wherein the halogenated hydrocarbon is 1,1,2-trichloro-1,2,2-trifluoroethane.

14. The method of claim 12 wherein the concentration of basic metal is between about 0.01% and about 0.3%.

15. The method of claim 12 wherein the concentration of basic metal is between about 0.01% and about 0.2%.

16. The method of claim 12 wherein the surfactant is a fluorinated alkyl ester.

17. The method of claim 12 wherein the predominant particle size is between 0.01 and 0.9 micron.

18. The method of claim 12 wherein the average particle size is between 0.2 and 0.6 micron.

19. The method of claim 12 wherein the average surface area of the particles ranges from 50 to 200 $m^2/g$ BET.

20. The method of claim 12 wherein the basic metal is an oxide of magnesium oxide.

21. The method of claim 12 wherein the basic metal is a salt selected from magnesium carbonate, zinc carbonate, sodium carbonate, potassium carbonate, calcium carbonate, sodium hydroxide, potassium hydroxide and calcium hydroxide.

22. The method of claim 12 wherein the basic metal is a salt of calcium carbonate.

23. The method of claim 12 wherein the concentration of the surfactant is between about 0.005% and about 1.0%.

24. The method of claim 12 wherein the concentration of the surfactant is between about 0.005% and 0.5%.

* * * * *